US009704679B2

(12) United States Patent
Nomura et al.

(10) Patent No.: US 9,704,679 B2
(45) Date of Patent: Jul. 11, 2017

(54) GAS CIRCUIT BREAKER

(71) Applicant: Hitachi, Ltd., Chiyoda-ku, Tokyo (JP)

(72) Inventors: Daisuke Nomura, Tokyo (JP); Noriyuki Yaginuma, Tokyo (JP); Yuuji Kaneko, Tokyo (JP); Makoto Hirose, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/904,193

(22) PCT Filed: Apr. 18, 2014

(86) PCT No.: PCT/JP2014/060996
§ 371 (c)(1),
(2) Date: Jan. 11, 2016

(87) PCT Pub. No.: WO2015/008515
PCT Pub. Date: Jan. 22, 2015

(65) Prior Publication Data

US 2016/0133407 A1 May 12, 2016

(30) Foreign Application Priority Data

Jul. 19, 2013 (JP) ..... 2013-150049

(51) Int. Cl.
*H01H 33/74* (2006.01)
*H01H 33/70* (2006.01)
*H01H 33/91* (2006.01)

(52) U.S. Cl.
CPC ..... *H01H 33/91* (2013.01); *H01H 33/703* (2013.01); *H01H 33/7023* (2013.01); *H01H 33/74* (2013.01); *H01H 2205/002* (2013.01)

(58) Field of Classification Search
CPC .. H01H 33/74; H01H 33/703; H01H 33/7023; H01H 33/7038; H01H 33/7046
(Continued)

(56) References Cited

U.S. PATENT DOCUMENTS 4,046,979 A * 9/1977 Hertz ..... H01H 33/901 218/66
4,048,456 A * 9/1977 Noeske ..... H01H 33/703 218/64
(Continued)

FOREIGN PATENT DOCUMENTS

JP 54-37270 A 3/1979
JP 58-165232 A 9/1983
(Continued)

OTHER PUBLICATIONS

Translation of JP 2003297198 (original doc. published Oct. 17, 2003).*
(Continued)

*Primary Examiner* — Truc Nguyen
*Assistant Examiner* — William Bolton
(74) *Attorney, Agent, or Firm* — Crowell & Moring LLP

(57) ABSTRACT

A gas circuit breaker including a pair of main contacts is openable inside an insulating tank. A pair of arc contacts is arranged on the inner side of the main contacts, and a puffer cylinder has the main contacts and the arc contacts at an end. A puffer chamber is formed inside the puffer cylinder, and a puffer piston is provided on the inner periphery of the puffer cylinder. An insulating nozzle part is mounted on an end of the puffer cylinder to surround the arc contact. The insulating nozzle part includes a split nozzle base part and a split nozzle end part, and the split nozzle base part has a throat part.

8 Claims, 7 Drawing Sheets

(58) Field of Classification Search
USPC ... 218/46, 53, 54, 57, 62–64, 72, 74, 73, 97
See application file for complete search history.

(56) References Cited

U.S. PATENT DOCUMENTS

| | | | | | |
|---|---|---|---|---|---|
| 5,179,257 | A * | 1/1993 | Dufournet | ..... | H01H 33/98<br>218/62 |
| 5,814,781 | A * | 9/1998 | Koyanagi | ..... | H01H 33/904<br>218/60 |
| 6,740,837 | B2 * | 5/2004 | Zehnder | ..... | H01H 33/7069<br>218/43 |

FOREIGN PATENT DOCUMENTS

| | | | | | |
|---|---|---|---|---|---|
| JP | 9-147704 | A | | 6/1997 | |
| JP | 2003-297198 | A | | 10/2003 | |
| JP | 2009129867 | | * | 6/2009 | ..... H01H 33/70 |

OTHER PUBLICATIONS

Translation of JP 2009129867 (original doc. publised Jun. 11, 2009).*

International Search Report (PCT/ISA/210) issued in PCT Application No. PCT/JP2014/060996 dated Jun. 10, 2014 with English translation (five pages).

* cited by examiner

GAS CIRCUIT BREAKER

TECHNICAL FIELD

The present invention relates to a gas circuit breaker for power having arc extinguishing gas and, more particularly, to a structure of an insulating nozzle configuring a breaker part of the gas circuit breaker.

BACKGROUND ART

In recent years, a gas circuit breaker with enlarged capacity has been developed along with the development of a high-voltage and high-current electric power system. On the other hand, there is an increasing need for cost reduction and space saving by optimization of a breaker part structure, and it is required to ensure excellent breaking performance with further lowered operation force.

Generally, in a moving side breaker part of the gas circuit breaker including a heat puffer type circuit breaker, an insulating nozzle and a moving main contact are provided on a fixed side and a breaker part side more than a puffer cylinder side. The insulating nozzle is provided for the purpose of effectively blowing arc extinguishing gas that is compressed within a puffer cylinder to arc which occurs between a moving arc contact and a fixed arc contact.

As means for improving breaking performance, there is a method of increasing a pressure of arc extinguishing gas within the puffer cylinder by increasing a throat part of the insulating nozzle. In this method, as the circuit breaker is required to break a high-voltage and high-current, a large insulating nozzle becomes necessary.

A gas circuit breaker, in which a nozzle is divided into a first nozzle member including a nozzle throat part and a second nozzle member in an axial direction thereof, and the first nozzle member and the second nozzle member are fixed to a puffer cylinder by a moving conduction contact, is disclosed in PTL 1.

CITATION LIST

Patent Literature

PTL 1: JP-A-2003-297198

SUMMARY OF INVENTION

Technical Problem

In order to ensure performance of the circuit breaker, since central axes of a fixed side breaker part and a moving side breaker part are necessary to be aligned in a straight line, it is important to confirm a coaxial state of the breaker parts at the time of assembly.

If whether the nozzle throat part on the moving side and the fixed arc contact are present coaxially can be confirmed, it is possible to confirm the coaxial state of the breaker parts with high accuracy.

In the gas circuit breaker disclosed in PTL 1, the first nozzle member is configured to have the nozzle throat part. Thus, since the nozzle throat part is hidden in an end of the first nozzle member, there is a problem that it is difficult to confirm whether the nozzle throat part and the fixed arc contact are present coaxially.

Solution to Problem

The present invention has been made in view of the above problems and the invention provides a gas circuit breaker including: a pair of main contacts being configured of a fixed main contact and a moving main contact and being openable inside a tank filled with arc extinguishing gas; a pair of arc contacts being arranged on the inner side of the main contacts and being configured of a fixed arc contact and a moving arc contact; a puffer cylinder having one of the moving side main contact and the moving arc contact at an end thereof; a puffer chamber being formed inside the puffer cylinder; a puffer piston being provided on the inner periphery of the puffer cylinder; and an insulating nozzle part being mounted on an end of the puffer cylinder to surround the moving arc contact and forming a flow channel to guide the arc extinguishing gas from the puffer chamber to between the arc contacts. The insulating nozzle part includes a split nozzle base part having a portion from a connection part to a puffer cylinder end to a throat part, and a split nozzle end connected thereto.

Advantageous Effects of Invention

The invention having the above-described configuration can provide the gas circuit breaker that can easily confirm the coaxial state of the breaker part with high accuracy at the time of assembly, improves assembling workability, and has excellent breaking performance even in a large insulating nozzle having a long throat part.

DESCRIPTION OF EMBODIMENTS

Hereinafter, embodiments of the invention will be described with reference to the drawings. The following descriptions are merely examples of implementation, and are not intended to limit the contents of the invention to the following detailed embodiments. The invention itself can be implemented in various embodiments in accordance with the contents described in the scope of claims. For example, the invention of the present application can be applied to a two-chamber heat puffer type circuit breaker.

Embodiment 1

Figure 1:
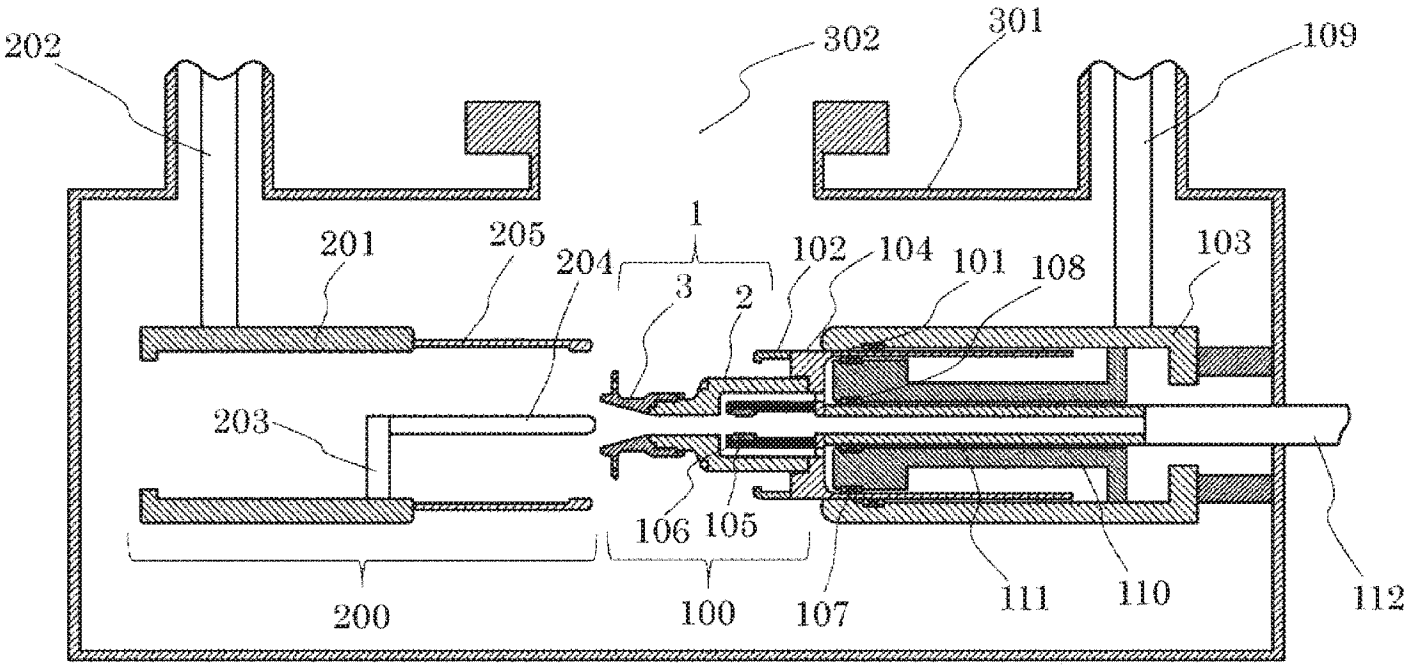
FIG. 1 is a sectional view of a breaking state of a gas circuit breaker to which a split nozzle structure of Embodiment 1 is applied.

FIG. 1 is a schematic view of an inside of a gas circuit breaker configured by using a split nozzle base part 2 and a split nozzle end part 3 of the aspect of the present invention. Configurations other than the split nozzle base part 2 and the split nozzle end part 3 are the same as configurations of a conventional puffer type gas circuit breaker.

An insulating tank 301 is filled with arc extinguishing gas such as $SF_6$ and a fixed side conductor 202 and a moving side conductor 109 are drawn into the insulating tank 301.

The fixed side conductor 202 is electrically connected to a fixed side main circuit conductor 201, a fixed arc contact base 203, a fixed arc contact 204, and a fixed main contact 205 configuring a fixed side breaker part 200. The fixed arc contact 204 can be removed and mounted from and on the fixed arc contact base 203.

The moving side conductor 109 is electrically connected to a moving side breaker part 100 via a moving side main circuit conductor 103, a sliding contact 101, and a puffer cylinder 104. A puffer piston 110 is connected to an inside of the moving side main circuit conductor 103. A puffer cylinder support sliding guide 107 mounted on an outer periphery of the puffer piston 110 and the sliding contact 101 mounted on the inner periphery of the moving side main circuit conductor 103 concentrically support the puffer cylinder 104 in a sandwich manner. According to the configuration, the puffer cylinder 104 is movable in an axial direction while maintaining electric connection to the moving side main circuit conductor 103.

A through-hole is provided in the center of the puffer piston 110, a puffer shaft 111 passes through the inside thereof, and the puffer shaft 111 is supported by a puffer shaft support sliding guide 108 mounted on the inner periphery of the puffer piston 110. One end of the puffer shaft 111 is fixed to the puffer cylinder 104 and the other end is connected to an insulating rod 112. According to the configuration, the moving side breaker part 100 is operated in the axial direction by an operation unit (not illustrated) connected to the other end of the insulating rod 112.

Further, an intermediate portion of the insulating tank 301 has a side hole 302 for maintaining a part of the moving side breaker part 100 and the fixed side breaker part 200.

Figure 2:
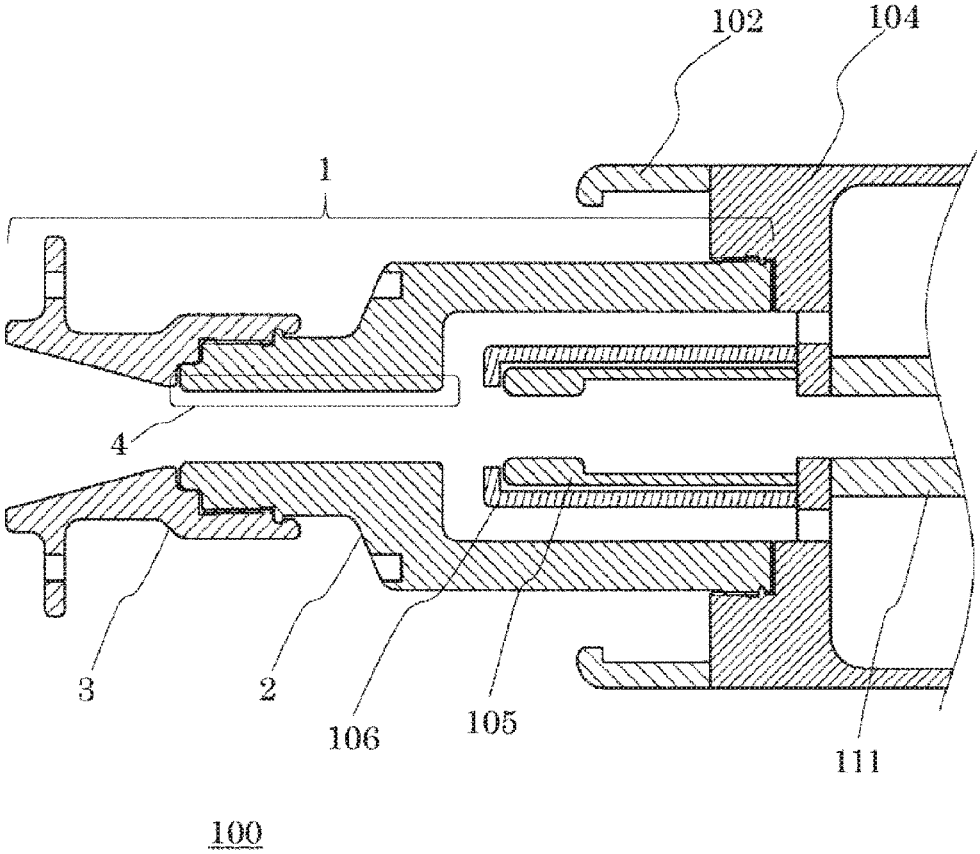
FIG. 2 is a sectional view of a moving side breaker part to which the split nozzle structure of Embodiment 1 is applied.

FIG. 2 is an enlarged view of the moving side breaker part 100 in FIG. 1. A moving arc contact 105 is provided in the center of the end of the puffer cylinder 104. On an outer periphery of the moving arc contact 105, an insulating cover 106, an insulating nozzle part 1, and a moving main contact 102 are respectively concentrically provided so as to surround the outer periphery of the moving arc contact 105. Moreover, in general, an end of the moving arc contact 105 is positioned on the fixed side breaker part 200 side more than the moving main contact 102.

If the moving side breaker part 100 moves from a state of FIG. 1 to a fixed side of FIG. 1, first, the moving arc contact 105 comes into contact with the fixed arc contact 204 and is electrically connected to the fixed arc contact 204. Even thereafter, the operation of the moving side breaker part 100 continues and finally moves to a position of an inserted state illustrated in FIG. 3. In this position, the moving main contact 102 is inserted into the inside of the fixed main contact 205 and the moving side breaker part 100 and the fixed side breaker part 200 are electrically and completely connected to each other.

Figure 3:
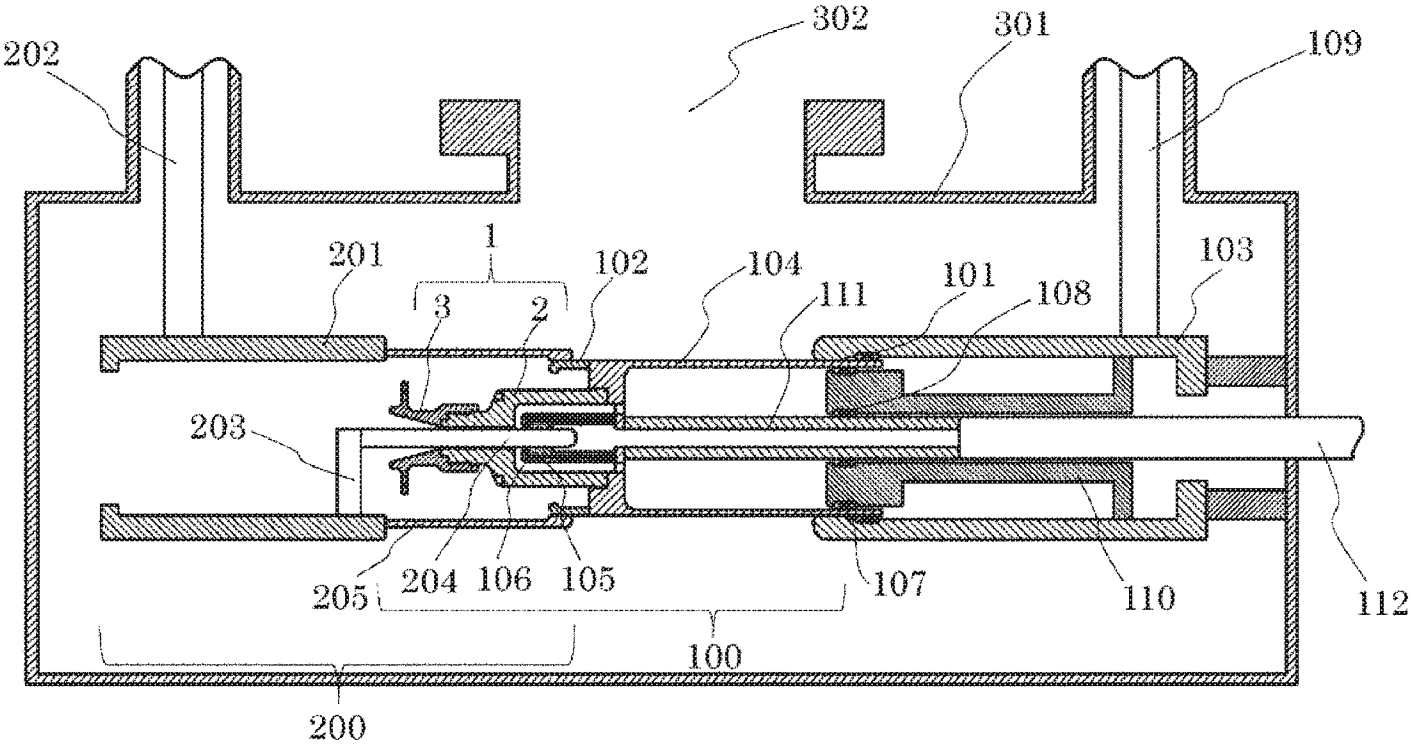
FIG. 3 is a sectional view of an inserted state of the gas circuit breaker to which the split nozzle structure of Embodiment 1 is applied.

Conversely, if the moving side breaker part 100 moves from a state of FIG. 3 to a moving side, first, the moving main contact 102 is separated from the fixed main contact 205 and then the moving arc contact 105 is separated from the fixed arc contact 204. In this case, if a large current flows through between the moving side breaker part 100 and the fixed side breaker part 200, even if the moving arc contact 105 and the fixed arc contact 204 are separated, the current is not interrupted, arc is generated between contacts of the moving arc contact 105 and the fixed arc contact 204, and the current continuously flows.

In the puffer type gas circuit breaker, arc extinguishing gas within the puffer cylinder 104 is compressed by the puffer piston 110 by a series of breaking operations, the arc extinguishing gas is blown to the arc, and then the arc is arc-distinguished, and the moving side breaker part 100 and the fixed side breaker part 200 are electrically cut-off. High-temperature and high-pressure arc extinguishing gas (hereinafter, referred to as hot gas) flows through the inside of the insulating nozzle part 1 at the time of a breaking operation.

As illustrated in FIG. 2, the insulating nozzle part 1 is configured of the split nozzle base part 2 and the split nozzle end part 3, and both are formed of polytetrafluoroethylene (PTFE). Moreover, a material other than PTFE may be used as long as the material is an insulating material excellent in heat resistance and mechanical strength. Furthermore, the insulating material may contain additives such as boron nitride, aluminum oxide, and molybdenum disulfide.

Figure 4:
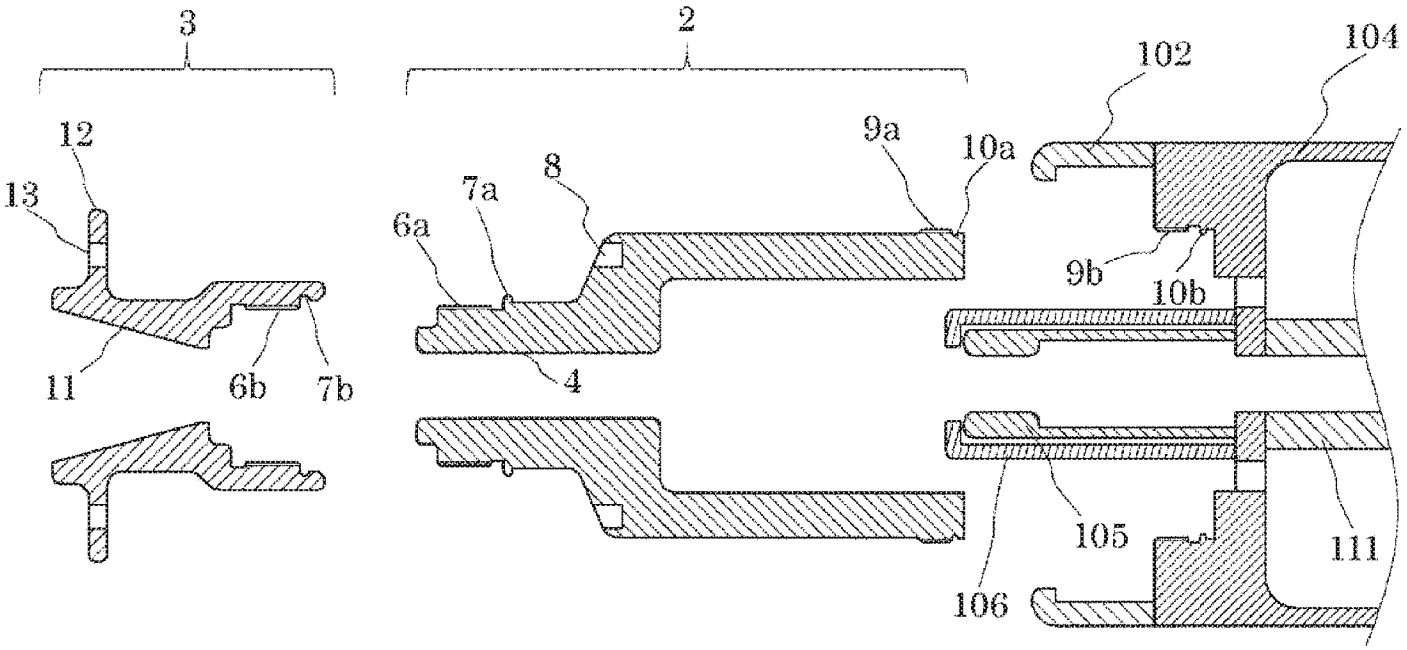
FIG. 4 is an exploded sectional view illustrating a structure of a split nozzle base part and a split nozzle end part of Embodiment 1.

FIG. 4 is a sectional view of a state where the split nozzle base part 2 and the split nozzle end part 3 are disassembled from the end of the moving side breaker part 100.

The split nozzle base part 2 has a multi-stage cylinder structure having a passage of arc extinguishing gas on the inside thereof, one end (fixed side end) of the passage of arc extinguishing gas on the inside has a throat part 4 having an inner diameter greater than an outer diameter of the fixed arc contact 204, and the other end (moving side end) has an inner diameter having a space that is capable of housing the moving arc contact. 105 and the insulating cover 106 on the inside thereof. Moreover, the throat part 4 has the minimum diameter of the passage of arc extinguishing gas within the insulating nozzle part 1.

On an outer periphery of the end of the split nozzle base part 2 on the throat part 4 side, a male screwpart 6*a*, a drop-off prevention part 7*a*, and a tightening jig processing part 8 are provided.

On the outer periphery of the other end, a male screw part 9*a* and a drop-off prevention part 10*a* are provided. The male screw part 9*a* is screwed into a female screw part 9*b* of the puffer cylinder 104, the drop-off prevention part 10*a* is fitted into a drop-off prevention part 10*b* of the puffer cylinder 104, and thereby the split nozzle base part 2 is connected to the puffer cylinder 104.

The tightening jig processing part 8 is configured of a plurality of holes that are, for example, disposed on the same circumference, a tightening jig having pin-shaped protrusion portions hooks into the holes, and the male screw part 9*a* is screwed into the female screw part 9*b*, or torque can be applied in a direction of loosening. Moreover, a shape of the tightening jig processing part 8 is not limited to the hole and may be a plurality of grooves, and the like arranged radially.

Also, the split nozzle end part 3 has a multi-stage cylinder structure having a passage of arc extinguishing gas on the inside thereof. One end of the inside has a taper part 11 of which an inner diameter on the end side is widened.

On the inside of the other end, a female screw part 6*b* and a drop-off prevention part 7*b* are provided. The split nozzle end part 3 is connected to the nozzle base part 2 by screwing between the female screw part 6*b* and a male part 6*a* of the split nozzle base part 2, and fitting between the drop-off prevention part 7*b* and the drop-off prevention part 7*a* of the split nozzle base part 2.

Figure 5:
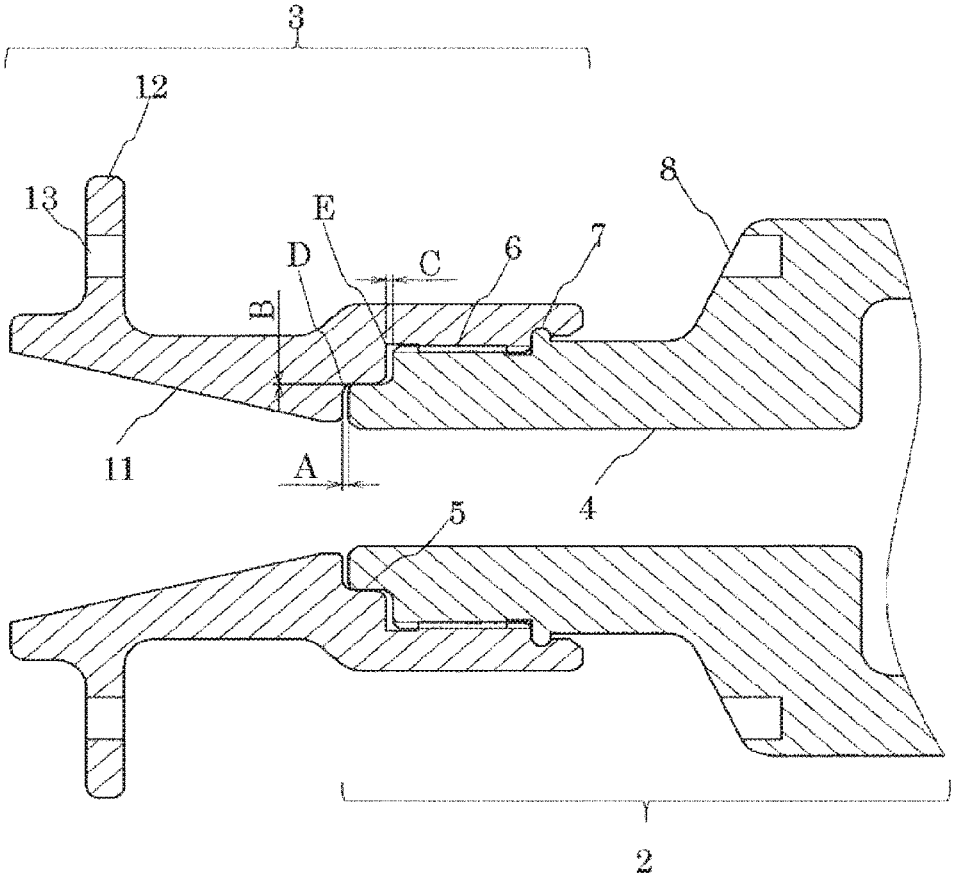
FIG. 5 is an enlarged sectional view illustrating a connection part of the split nozzle base part and the split nozzle end of Embodiment 1.

FIG. 5 illustrates an enlarged view of a state where the split nozzle base part 2 and the split nozzle end part 3 are assembled.

A boundary of the split nozzle base part 2 and the split nozzle end part 3 has a fitting part 5 to prevent entry of hot gas into a screwing part 6. Moreover, effects of the fitting part 5 will be described later and a first gap A between the split nozzle end part 3 and the split nozzle base part 2 is not provided in the middle of the throat part 4 and is provided on the fixed side more than the throat part 4. This is because the pressure of arc extinguishing gas is increased in the throat part 4 having a small area through which gas flows. Thus, since a burden on the strength is large, a distance between the fixed arc contact 204 and the split nozzle base part 2 is close and a high electric field is present within the throat part 4, turbulence of gas flow occurs by providing a step and the like, and if a region in which a density of arc extinguishing gas is locally lowered occurs, the arc flows through the region and it causes degradation of the performance.

In this embodiment, on the outer periphery of the nozzle end part 3 on the taper part 11 side, a guard part 12 is provided. A tightening jig processing part 13 is provided in the guard part 12. The tightening jig processing part 13 is configured of a plurality of holes that are, for example, disposed on the same circumference, a tightening jig having pin-shaped protrusion portions hooks into the holes, the male screw part 6*a* is screwed into the female screw part 6*b*, or torque can be applied in a direction of loosening. Moreover, a shape of the tightening jig processing part 13 is not limited to the hole and may be a plurality of grooves, and the like arranged radially.

According to the structure, the tightening jig is hooked into the tightening jig processing part 8 of the split nozzle base part 2 and the tightening jig processing part 13 of the split nozzle end part 3, torque is applied, and thereby the screwing part 6 is loosened or fastened. Thus, the insulating nozzle part 1 may be assembled or disassembled into the split nozzle base part 2 and the split nozzle end part 3.

Furthermore, the split nozzle base part 2, the split nozzle end part 3, and the fixed arc contact 204 are designed to respectively be a size capable of passing through between the moving main contact 102 and the fixed main contact 205. Thus, it is also possible to remove the split nozzle base part 2, the split nozzle end part 3, and the fixed arc contact 201 from the side hole 302 by splitting of the insulating nozzle part 1 and removing of the fixed arc contact 204 from the fixed arc contact base 203.

Figure 6:
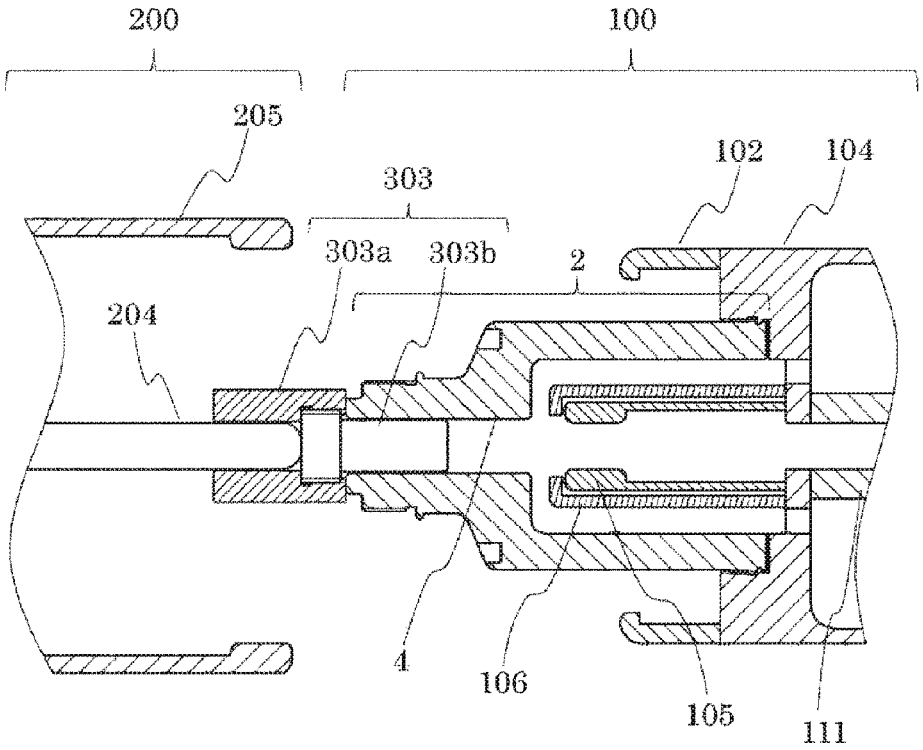
FIG. 6 is a sectional view illustrating an example of a coaxial confirming method of a breaker part to which the split nozzle structure of Embodiment 1 is applied.

FIG. 6 illustrates an outline of a confirming operation of a coaxial state of the breaker part using the nozzle having the split structure.

In the breaker part, it is important that the fixed side breaker part 200 and the moving side breaker part 100 are aligned coaxially and if the axes are not aligned, it causes degradation of the performance or failures such as breakage.

The moving side breaker part 100 is not connected to the split nozzle end part 3 and the throat part 4 of the split nozzle base part 2 is in a state of being disposed in the end of the moving side breaker part 100. In this case, it is preferable that connection between the moving side breaker part 100 and the operation unit is cut-off, and the moving side breaker part 100 is in a state of arbitrarily moving.

A coaxial state confirming jig 303 is mounted on the end of the fixed arc contact 204 of the fixed side breaker part 200. The jig 303 is, for example, a split structure, a fixed side jig 303*a* has a hole through which the fixed arc contact 204 is inserted in one end thereof and a cylindrical structure having a screwing part for connecting to a moving side jig 303*b* in the other end thereof.

The moving side jig 303*b* has a screwing part for connecting to the fixed side jig 303*a* in one end thereof and has a cylindrical part for inserting into the throat part 4 of the split nozzle base part 2 in the other end thereof. In addition, the fixed side jig 303*a* and the moving side jig 303*b* respectively have lengths capable of passing through between the fixed arc contact 204 and the split nozzle base part 2 in a state where the moving side breaker part 100 is opened on the breaking side. It is preferable that a material of the jig 303 is a resin material, for example, nylon and the like that has no possibility to damage the fixed arc contact 204 and the split nozzle base part 2.

First, in a state where the moving side breaker part 100 is opened on the breaking side, the fixed side jig 303*a* passes through the fixed arc contact 204. Next, the moving side jig 303*b* is screwed into the fixed side jig 303*a* and connected to each other.

In this state, the jig 303 or the moving side breaker part 100 is operated, the end of the moving side jig 303*b* is inserted into the throat part 4, and conditions of fitting are confirmed. Thus, at is possible to confirm the coaxial state of the breaker part from the side hole 302 of the insulating tank 301, that is, from the side surfaces of the fixed side contact 200 and the moving side breaker part 100. Furthermore, it is possible to grasp a size of a displacement of the breaker part even by feeling when operating the jig 303. Thus, it is possible to easily perform fine adjustment of an assembled state.

In the above-described method, since the coaxial state of the fixed arc contact 204 and the throat part 4 can be confirmed with high accuracy, improvement of the breaking performance can be expected. Moreover, if the coaxial state of the breaker part is shifted, for example, an entire position of the fixed side breaker part 200 is adjusted, but details of an adjusting method will not be described in the embodiment because a suitable method is varied by the structure of the circuit breaker.

Moreover, although not illustrated, as the confirming method of the coaxial state, instead of the split nozzle base part 2, a method, in which confirmation of the coaxial state is performed using a dummy nozzle having the throat part 4 that is short and has an inner diameter close to the diameter of the fixed arc contact 204, and then the dummy nozzle is replaced by the split nozzle base part 2, is also effective.

After the coaxial state of the breaker part is confirmed by the above-described steps, the split nozzle end part 3 is used by assembling on the split nozzle base part 2.

As described above, it is possible to adjust the coaxial state of the breaker part with high accuracy by using the method of the embodiment even in the nozzle of which the throat part 4 is longer and larger than the insulating nozzle of the conventional circuit breaker. Thus, it is possible to provide the gas circuit breaker having excellent breaking performance and reliably.

Next, an effect of the configuration of the embodiment having the fitting part 5 will be described with reference to FIG. 5. The fitting part 5 has the first gap A that is opened in the axial direction, a corner D, a second gap B that is opened in the radial direction, a corner B, and a third gap C that is opened in the axial direction.

Since the PTFE forming the insulating nozzle 1 is liable to expand by an increase in temperature, absorption of moisture, and the like, if the first gap A or the third gap C that is opened in the axial direction is eliminated by the expansion of the insulating nozzle part 1, the split nozzle end part 3 receives a force in a direction that causes the split nozzle end part 3 to drop off to the fixed side breaker part 200 side. Thus, the first gap A and the third gap C have dimensions anticipating a margin of the expansion of the PTFE.

On the other hand, the second gap B has a dimension smaller than that of the first gap A or the third gap C. If the second gap B and the corner D do not exist, when the first gap A is directly connected to the corner E, there is a concern that some of high-pressure hot gas passing through the inside of the insulating nozzle part 1 flows into the first gap A and enters the screwing part 6 via the corner E.

If some of the PTFE that is dissolved and carbonized in the arc at the time of breaking is mixed with hot gas and enters the screwing part 6, carbide accumulates in the screwing part. In addition, hot gas is stagnated in the screwing part 6 and thereby the PTFE of the surface of the screwing part 6 is heated and may be carbonized. If carbide is accumulated in the screwing part 6, there is a concern that the insulating performance of the insulating nozzle part 1 is lowered.

As the embodiment, if the second gap B and the corner exist, the flow channel area of hot gas is rapidly narrowed in the second gap B. Thus, it is possible to minimize a hot gas amount that reaches the screwing part 6. Thus, since accumulation of carbide in the screwing part 6 is suppressed by providing the fitting part 5, it is possible to maintain the insulating performance of the insulating nozzle part 1 for a long period of time. Moreover, it is preferable that a dimension of a diameter of the second gap B is, for example, approximately 0.5 mm to 1.5 mm.

Furthermore, since a force is applied to the split nozzle end part to the outside by an internal pressure received from hot gas, stress is concentrated on the corner E, it causes failures such as breakage. Also for the stress received from the hot gas, since the stress is dispersed in the corner D and the corner E, it is excellent in strength.

Figure 9:
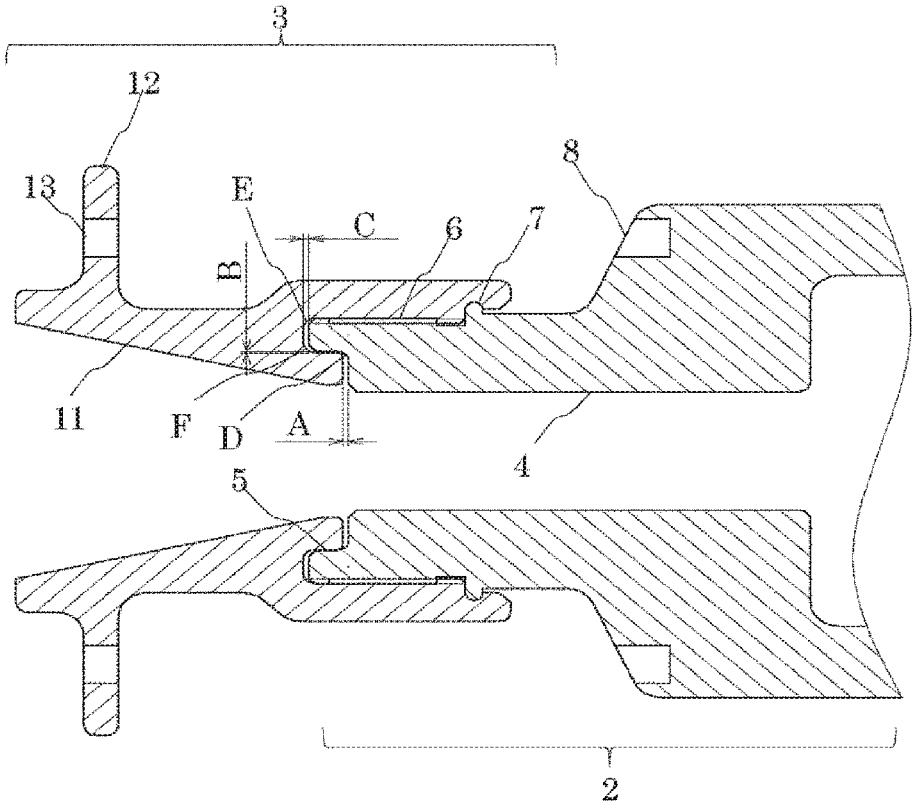
FIG. 9 is a sectional view illustrating a modification example of Embodiment 1.

Moreover, as an example illustrated in FIG. 9, the fitting part 5 may be a structure in which a corner F is provided between the second gap B and the corner E, and directions of concave and convex are reversed, and it is possible to achieve the same effects as those of the above description.

The guard part 12 of the split nozzle end part 3 has an outer diameter, for example, equal to or greater than 2.5 times the inner diameter of the throat part 4. Thus, a torque load is easily available when connecting or disassembling the split nozzle end part 3 and the split nozzle base part 2, and a function of preventing hot gas ejected from the insulating nozzle part 1 from flowing into the moving main contact 102 side is provided. Therefore, it is possible to prevent adverse effects on the insulating performance.

If the insulating nozzle part 1 is an integral structure, technical difficulty of an integral molding or processing with high accuracy of the insulating nozzle part 1 is increased. Thus, in the integral structure, although the size of the guard part 12 is restricted, it is easy to manufacture the guard part 12 by increasing the diameter thereof and it is easy to configure to prevent hot gas from flowing into the moving main contact 102 side by making the insulating nozzle part 1 be the split structure.

Figure 7:
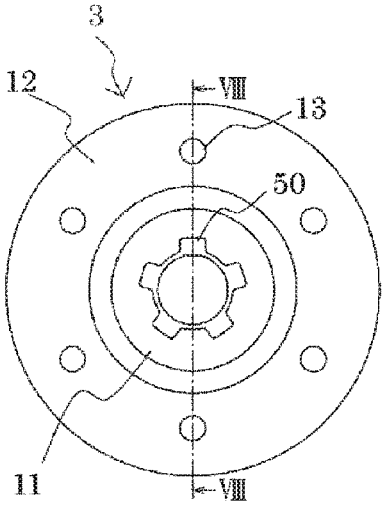
FIG. 7 is a view illustrating an example in which a slit part is provided in a taper part of the split nozzle end of Embodiment 1.
Figure 8:
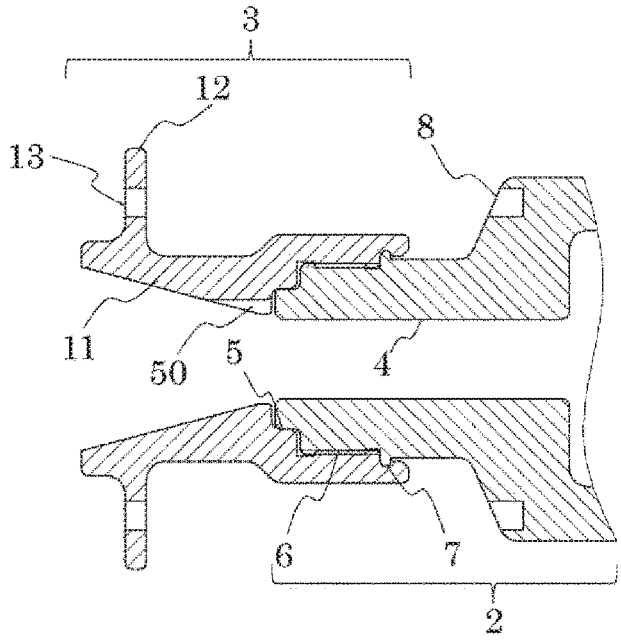
FIG. 8 is a sectional view that is taken along line VIII-VIII of FIG. 7.

FIGS. 7 and 8 illustrate an example in which an extending slit part 50 is provided in the taper part 11 of the split nozzle end 3, that is, on the inner side of the split nozzle end part 3 in the axial direction of the split nozzle end part 3. It is possible to give a change in a cross section shape of the flow channel of hot gas immediately after the fixed arc contact 204 passes through the throat part 4 at the time of the breaking operation by providing the extending slit part 50 in the taper part 11.

As a result, it is possible to be a design to increase a degree of freedom with respect to a change in the flow of arc extinguishing gas. For example, when hot gas reaches the taper part 11 after passing through the throat part 4, since a cross section area of the flow channel is different in a portion in which the slit part 50 exists and a portion in which the slit part 50 does not exist, a difference occurs in ease of flow of hot gas. Therefore, since the flow of hot gas is disturbed after passing through the throat part 4, a layer in which particularly high-temperature gas is gathered and a layer in which relatively low-temperature gas is gathered in hot gas are agitated, and cooling of the high-temperature gas is promoted. Thus, it is possible to expect improvement of the breaking performance.

Moreover, a structure in which the slit is partially provided in the flow channel of hot gas and complicated flow is aimed for can be also possible in the conventional structure, but according to the structure of the embodiment, since only the split nozzle end 3 can be manufactured separately, there is an advantage that the slit part 50 can be relatively easily processed with high accuracy.

The above description is an example and the slit part 50 is not limited to a groove having a uniform depth as illustrated in FIGS. 7 and 8, and a complicated shape thereof can also be easily processed by making the insulating nozzle part 1 be the split structure. In some cases, there is an advantage that the range of selection of a nozzle design is widened such that the split nozzle base part 2 and the split nozzle end part 3 are made of different materials or by a different blending of additives.

REFERENCE SIGNS LIST

1 . . . insulating nozzle part
2 . . . split nozzle base part
3 . . . split nozzle end part
4 . . . throat part
5 . . . fitting part
6 . . . screwing part
6*a* . . . male screw part
6*b* . . . female screw part
7 . . . engaging part
7*a* . . . drop-off prevention part
7*b* . . . drop-off prevention part
8 . . . tightening jig processing part
9 . . . screwing part
9*a* . . . male screw part
9*b* . . . female screw part
10 engaging part
10*a* . . . drop-off prevention part
10*b* . . . drop-off prevention part
11 . . . taper part
12 . . . guard part
13 . . . tightening jig processing part
50 . . . slit part
100 . . . moving side breaker part
101 . . . sliding contact
102 . . . moving main contact
103 . . . moving side main circuit conductor
104 . . . puffer cylinder
105 . . . moving arc contact
106 . . . insulating cover
107 . . . puffer cylinder support sliding guide

108 . . . puffer at support sliding guide
109 . . . moving side conductor
110 . . . puffer piston
111 . . . puffer shaft
112 . . . insulating rod
200 . . . fixed side breaker part
201 . . . fixed side main circuit conductor
202 . . . fixed side conductor
203 . . . fixed arc contact base
204 . . . fixed arc contact
205 . . . fixed main contact
301 . . . insulating tank
302 . . . side hole
303 . . . jig
303*a* . . . jig fixed side
303*b* . . . jig moving side
A . . . first gap
B . . . second gap
C . . . third gap

The invention claimed is:

1. A gas circuit breaker comprising:

a pair of main contacts being openable inside an insulating tank;

a pair of arc contacts being arranged on an inner side of the main contacts;

a puffer cylinder having one of the main contacts and the arc contacts at an end;

a puffer chamber being formed inside the puffer cylinder;

a puffer piston being provided on an inner periphery of the puffer cylinder; and an insulating nozzle part being mounted on an end of the puffer cylinder to surround the one arc contact, wherein the insulating nozzle part includes a split nozzle base part and a split nozzle end part, the split nozzle base part has a throat part, a fitting part is provided in a connection part of the split nozzle end part and the split nozzle base part, and the fitting part has a first gap, a second gap, and a third gap, the first gap and the third gap opening in an axial direction of the insulating nozzle part, and the second gap connecting the first gap and the third gap, and opening in a radial direction of the insulating nozzle part.

2. The gas circuit breaker according to claim 1, wherein the second gap is narrower than the first gap and the third gap.

3. The gas circuit breaker according to claim 2, further comprising a guard part being provided on an outer periphery of the split nozzle end part.

4. The gas circuit breaker according to claim 2, slits are provided on an inner side of the split nozzle end part.

5. The gas circuit breaker according to claim 1, further comprising a guard part being provided on an outer periphery of the split nozzle end part.

6. The gas circuit breaker according to claim 5, slits are provided on an inner side of the split nozzle end part.

7. The gas circuit breaker according to claim 1, wherein slits are provided on an inner side of the split nozzle end part.

8. The gas circuit breaker according to claim 1, wherein a slit is provided on the inner side of the split nozzle end part.

* * * * *